US008057286B2

(12) United States Patent
Walsh

(10) Patent No.: US 8,057,286 B2
(45) Date of Patent: Nov. 15, 2011

(54) SANDING BLOCKS FOR USE WITH ADHESIVE-BACKED SANDPAPER

(75) Inventor: David C. Walsh, Bogart, GA (US)

(73) Assignee: Style-Line Corporation International, Bogart, GA (US)

( * ) Notice: Subject to any disclaimer, the term of this patent is extended or adjusted under 35 U.S.C. 154(b) by 0 days.

(21) Appl. No.: 11/554,757

(22) Filed: Oct. 31, 2006

(65) Prior Publication Data

US 2007/0099551 A1 May 3, 2007

Related U.S. Application Data

(60) Provisional application No. 60/731,772, filed on Oct. 31, 2005.

(51) Int. Cl.
*B24D 11/00* (2006.01)

(52) U.S. Cl. ..... 451/523; 451/495

(58) Field of Classification Search ..... 451/495, 451/523–525

See application file for complete search history.

(56) References Cited

U.S. PATENT DOCUMENTS

| | | | | |
|---|---|---|---|---|
| 2,414,036 | A * | 1/1947 | Gerhan | 451/512 |
| 4,263,755 | A * | 4/1981 | Globus | 451/490 |
| 4,501,096 | A * | 2/1985 | Lukianoff | 451/502 |
| 4,640,060 | A | 2/1987 | Lukianoff | |
| 4,887,396 | A * | 12/1989 | Lukianoff | 451/523 |
| 5,007,483 | A * | 4/1991 | McGuire | 168/48.1 |
| 5,131,193 | A * | 7/1992 | Demers | 451/524 |
| 5,177,909 | A * | 1/1993 | Klocke | 451/490 |
| 5,203,123 | A * | 4/1993 | Travis | 451/490 |
| 5,662,519 | A * | 9/1997 | Arnold | 451/525 |
| 5,718,622 | A * | 2/1998 | Jones | 451/524 |
| 5,759,090 | A * | 6/1998 | Kawate et al. | 451/56 |
| 5,885,148 | A * | 3/1999 | Vargas et al. | 451/523 |
| 6,099,603 | A * | 8/2000 | Johnson | 51/297 |
| 6,120,365 | A * | 9/2000 | Johnson | 451/495 |
| 6,439,988 | B1 * | 8/2002 | Long et al. | 451/495 |
| 6,500,057 | B1 * | 12/2002 | Medina | 451/354 |
| 6,544,113 | B1 * | 4/2003 | Wheeler | 451/495 |
| 2001/0000503 | A1 * | 4/2001 | Beaudry et al. | 451/523 |
| 2002/0173258 | A1 * | 11/2002 | Biddle et al. | 451/490 |
| 2004/0038634 | A1 | 2/2004 | McCarthy | |
| 2007/0293130 | A1 * | 12/2007 | Miekka et al. | 451/526 |

FOREIGN PATENT DOCUMENTS

EP 904897 A2 * 3/1999

OTHER PUBLICATIONS

International Search Report and Written Opinion mailed Jul. 17, 2007 for International Application No. PCT/US06/42455.

* cited by examiner

*Primary Examiner* — Maurina Rachuba

(74) *Attorney, Agent, or Firm* — Sutherland Asbill & Brennan LLP

(57) ABSTRACT

A sanding block and a kit for sanding curved surfaces are provided. The sanding block includes an elongated body which has a first sanding surface; and a sandpaper removably affixed to the first sanding surfaces wherein the body is elastically deformable such that the block can conform against a curved surface to be sanded.

15 Claims, 4 Drawing Sheets

SANDING BLOCKS FOR USE WITH ADHESIVE-BACKED SANDPAPER

CROSS-REFERENCE TO RELATED APPLICATIONS

This application claims benefit of U.S. Provisional Application No. 60/731,772, filed Oct. 31, 2005. The application is incorporated herein by reference.

BACKGROUND OF THE INVENTION

This invention is generally in the field of hand tools for shaping and smoothing contoured surfaces, and more particularly sanding such surfaces to a desired smoothness or finish.

In numerous industries, products are made or repaired to have a desirably smooth, finished surface. Representative examples of these industries and products include furniture, shelving, and other woodworking; automotive body production and repair, nautical vessel body production and repair, exterior and interior finishing (e.g., drywall, kitchen countertops, bathroom vanities) in the construction of houses and other buildings. In all of these non-limiting examples, various surfaces require sanding to complete the product or project.

Flat surfaces and rounded surfaces with relatively large radii can generally be finished using power disk sanders or the like. However, surfaces having relatively sharp contours or curvilinear features generally require sanding by hand. For example, linear or elongated surface contours may be sanded by hand using contour sanders (i.e., sanding blocks) having a shape which fits into an almost perfect engagement with the elongated surface contour. However, when it is desired to sand another surface contour, another sander which mimics this new surface contour must be used. Furthermore, there are typically surface contours which do not have a matching pre-fabricated sanding block, and thus, finishing the surface becomes more difficult and/or less precise. For example, a conventional rigid sanding blocks designed for sanding a structure having a perfect 90° angle will gouge those structures that are imperfect, e.g., as found in some houses where corners may not be precisely 90°. Such blocks are also unforgiving of imperfect sanding strokes on even those corners that are perfect, and may still result in gouging. It therefore would be desirable to provide sanding blocks that offer better adaptability to different contoured surfaces for a variety of sanding applications.

SUMMARY OF THE INVENTION

Sanding blocks and kits of such blocks are provided for sanding surfaces, particularly curved surfaces, that are in need of sanding. In one embodiment, the sanding blocks include an elongated body which has a first sanding surface, and a sandpaper removably affixed to the first sanding surface, wherein the body is elastically deformable such that the block can confoim against a curved surface to be sanded. The elongated body may comprise a foamed polymer. such as a polyethylene material. The elongated body made of such foamed polymer may be designed to have a density between 1.8 pounds per cubic foot and 4 pounds per cubic foot. The sandpaper may be adhered to the sanding surface by a pressure-sensitive adhesive material. The elongated body may further have a holding surface. which is suitable for allowing the block to be securely held by a person's hand.

The elongated body preferably has a cross-sectional shape that is constant in the axial direction. In one embodiment, the cross-sectional shape comprises an ellipse. In another embodiment, the cross-sectional shape comprises a parallelogram having rounded corners.

The first sanding surface may one or more curved surfaces. In one embodiment, the curved sanding surface may have a shape selected from concave curvatures, convex curvatures, anvil-shaped curvatures, claw-shaped curvatures, French-curve curvatures, flat rectangular surfaces, and combinations thereof.

In one particular embodiment, the sanding block has a first sanding surface having a convex curvature, a second sanding surface which has a flat surface with rounded edges, a third sanding surface which has a concave curvature, a fourth sanding surface which has an anvil-shaped curvature, and a fifth sanding surface which has a claw-shaped curvature.

In another particular embodiment, the sanding block has a first sanding surface which includes a first offset concaved curvature, a second sanding surface which has second offset concaved curvature, a third sanding surface which has a first flat surface with an acute convex angle, a fourth sanding surface which has a second flat surface with an acute convex angle, a fifth sanding surface which has a first flat surface with a rounded edge, and a sixth sanding surface which has a second flat surface with a rounded edge.

In yet another particular embodiment, the sanding block has a first sanding surface which includes a flat surface with an acute angled edge, a second sanding surface which has a French curve curvature, a third sanding surface which has an elliptical convex curvature, a fourth sanding surface which has a concave curvature with a protrusion, and a fifth sanding surface which has a flat rectangular surface.

In yet a further particular embodiment, the sanding block has a first sanding surface which includes a French curve curvature, a second sanding surface which has a convex curvature with an acute convex angle, a third sanding surface which has a first concave curvature with convex edges, a fourth sanding surface which has a concave curvature with a protruding edge, and a fifth sanding surface which has a concave curvature with two protruding edges.

In another aspect, a kit of parts for sanding surfaces is provided. The kit has two or more sanding blocks, each sanding block including an elongated body having a first sanding surface to which sandpaper may be removably affixed, wherein the body is elastically deformable such that the sanding block can conform against a curved surface to be sanded, wherein the shapes of the first sanding surfaces of the two or more sanding blocks differ from one another, The kit may include at least one adhesive-backed sandpaper, which can be removably affixed to each of the first sanding surfaces. Each of the sanding blocks of the kit may be formed of a foamed polyethylene or other polymer.

DETAILED DESCRIPTION OF THE INVENTION

Figure 1:
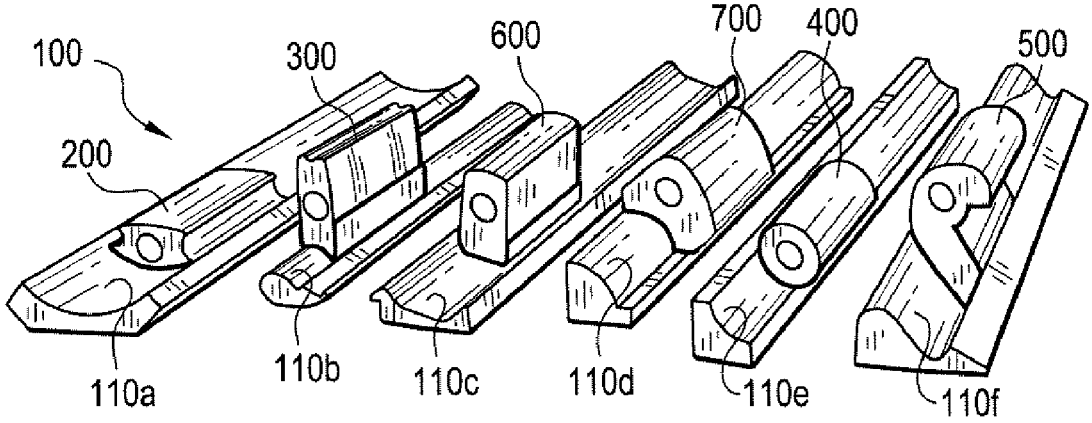
FIG. 1 is a perspective view of one embodiment of a kit of different shaped sanding blocks, shown positioned against a selection of differently shaped curved surfaces that may be sanded with the sanding blocks.

The present invention now will be described more fully hereinafter with reference to the accompanying drawings, in which exemplary embodiments of the invention are shown. This invention may, however, be embodied in many different forms and should not be construed as being limited to the embodiments set forth herein; rather, these embodiments are provided so that this disclosure will be thorough and complete, and will convey the scope of the invention to those skilled in the art.

Sanding blocks and kits for sanding curved surfaces have been developed to provide tools that can be used to sand and finish a plurality of curved surfaces. The blocks can be used for manual sanding or for sanding with the aid of a powered (e.g., electrical or pneumatic) device. Each block is elastically deformable and designed to hold a flexible sheet of sandpaper removably affixed to the block in the shape needed for uniform sanding of a selected contoured surface in need of sanding. Thus, the sanding surfaces of the sanding blocks are able to conform to the curved surface to be sanded, and the sanding blocks thereby can enable one to uniformly sand essentially any surface with ease.

As used herein, the terms "curved" and "contour" are used interchangeably and generally refer to the outside outline of any shaped structure, with irregular outlines that cannot be conveniently defined by combinations of straight lines and area of regular radii. Non-limiting examples of such contoured surfaces include crevices, co rnmers, or bends connecting planar surfaces.

In a preferred embodiment, the sandpaper is an adhesive backed sandpapers, such as a pressure sensitive adhesive-backed sandpaper as well known in the art. In alternative embodiments, the sandpaper may be affixed by a hook-and-loop type of securement means, a clip type of securement means, or other means well known in the art. The adhesive or other securement means need not cover the entire side of the sandpaper in contact with the sanding surface of the block.

In use, the sanding blocks may be used in an elastically deformed shape or in a substantially undeformed shape. For example, the adhesive-backed sandpaper may be applied directly to a surface of the sanding block in its unloaded state. Alternatively, the body of a sanding block may be made to conform to a curved surface to be sanded by (i) placing a portion of sandpaper having an adhesive backing against the surface to be sanded, i.e., with the adhesive backing side facing away from the surface to be sanded and taking a profile that matches the shape of the surface to be sanded; and then (ii) compressing the sanding block against the adhesive backing, with the compressive force being effective to elastically deform the sanding block into conforming engagement with the adhesive backing, such that the adhesive-backed sandpaper holds the sanding block in a customized profile as long as needed (during sanding and until the adhesive-backed sandpaper is removed), Once the adhesive-backed sandpaper is removed. the sanding block regains its original shape.

In one embodiment, the sanding block body may have soft, rounded edges which reduce or eliminate gouging of the surface to be sanded. In another embodiment, tapered edges of the body of the sanding block may allow for sanding up to and underneath small crevices.

In one aspect, a kit is provided which includes a plurality of sanding blocks designed in various configurations useful for effectively sanding a wide range of curved surfaces. One skilled in the art can select the most appropriate sanding block for each surface. For example, a sanding block may be chosen from a kit if the sanding block has a sanding surface which most closely mimics the contours of the surface to be sanded or which can be deformed easily to conform to the surface to be sanded. In one embodiment, at least one body of the sanding block from the kit is constructed of a material having a density that is different from the densities of the material(s) forming the bodies of the other sanding blocks, so as to provide a sanding block having a different firmness useful for particular applications.

As used herein, the terms "comprise," "comprising," "include," and "including" are intended to be open, non-limiting terms, unless the contrary is expressly indicated.

The Sanding Blocks

Reusable sanding blocks are provided, which are intended to be used with a replaceable, disposable sheet of sandpaper. In one aspect, a sanding block is provided with a body having a first sanding surface that is capable of holding sandpaper. The body is flexible, or elastically deformable, and can conform to a surface to be sanded. The body of the sanding block may be flexible in all directions.

In particular embodiments, the sanding block body may be made of a material that conforms to the surface when pressure is applied but recovers to its original shape after pressure is released. In some embodiments, each sanding block may include, but is not limited to, a closed-cell or open-cell extruded polymer such as polypropylene, polyethylene, or polystyrene or similar materials. In an exemplary embodiment, the body of the sanding block is a polyethylene foam. In a preferred embodiment, the sanding blocks are each made by an extrusion process using specially designed extrusion orifices to obtain the complex cross-sectional shapes (i.e. profiles) described herein.

The shape and hardness (i.e., elasticity or stiffness) of each sanding block is specifically tailored for effectiveness of different contoured structures in need of sanding. For a given material, such as a foamed polymer, this hardness may readily correlate with another physical property of the material, such as density. In other words, the density of the body of the sanding block may vary depending on the surface that needs to be sanded. In preferred embodiments, the body of the sanding block is a polyethylene foam and has a density between 1.8 pounds per cubic foot and 4 pounds per cubic foot. Density may be adjusted by controlling the degree of foaming, i.e., the amount of gas incorporated into the polymeric material during manufacture of the block material.

The sanding block may be of any predesigned shape and size to assist in the sanding of a desired surface. The sanding block body may include at least one sanding surface to engage the surface to be sanded. The sanding surface may be, but is not limited to, a concave curvature, a convex curvature, an anvil-shaped curvature, or a claw-shaped curvature or any other shape to engage a surface to be sanded. In an exemplary embodiment, the sanding block body may include a plurality of sanding surfaces wherein each sanding surface is configured to sand a different shaped surface. In another exemplary embodiment, the sanding block is configured to have a holding surface which fits in the hand of a person such that the sanding block is manually operated to sand the desired surface. In other embodiments, the sanding block body may be attached to a substrate or device which may facilitate manual or mechanized sanding.

Sandpaper may be removably affixed to at least one sanding surface of the sanding block body for sanding of a surface. Thus, the sanding block may be repeatedly used, and sanding paper of essentially any grit and for any application may be used with the sanding block. Any suitable means for affixing the sandpaper to the sanding surface may be used. For example, in one embodiment, an adhesive may be placed on the back of the sandpaper to removably affix the sandpaper to the sanding block body. Thus, in one embodiment, if a curved surface requires sanding, sandpaper may be removably affixed to a convex surface of the sanding block body so that the sandpaper may be shaped similarly to the surface to be sanded. The sanding block may be positioned on the sanding surface such that the affixed sandpaper is in contact with the desired surface to be sanded. Pressure may be then applied to the sanding block to enable the sanding block and affixed sandpaper to conform to the shape of the surface.

The present sanding blocks may be used with pressure sensitive adhesive-backed sandpapers, which are well known in the art. These sandpapers may have a peelable liner that is removed to enable attachment of the adhesive side of the sandpaper to the sanding surface of the sanding block.

FIG. 1 illustrates one embodiment of a kit 100 comprising a plurality of sanding blocks 200, 300, 400, 500, 600, and 700 for sanding a plurality of curved surfaces 110*a-f*. The kit 100 thus provides blocks accommodating a wide range of sanding needs for a wide range of sanding applications. Each of the sanding blocks 200, 300, 400, 500, 600, and 700 is described in more detail below in reference to FIGS. 2-7.

FIGS. 2-7 illustrate exemplary embodiments of sanding blocks, FIGS. 2-7 depict only the cross-section of the bodies of the sanding blocks. It should be understood that the sanding block bodies are typically elongated and may extend from the cross-section any appropriate length. The sanding blocks of FIGS. 2-7 are preferred embodiments of the present invention and are designed to operate in various sanding applications and environments. The sanding blocks are not necessarily limited to the embodiments of FIGS. 2-7.

Figure 2:
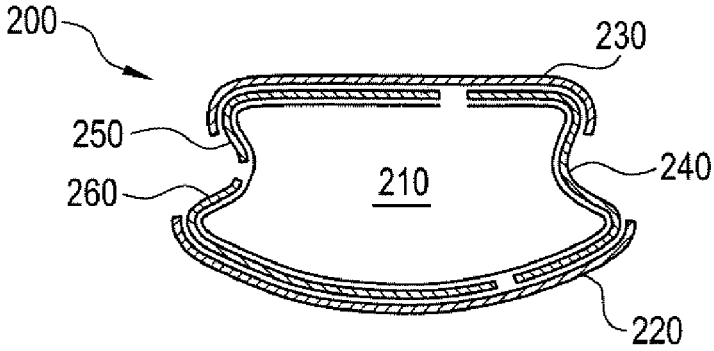
FIG. 2 is a cross-sectional view of one embodiment of a sanding block described herein.

FIG. 2 illustrates an embodiment of a sanding block 200. The sanding block 200 includes body 210 having a first sanding surface 220. The first sanding surface 220 comprises a convex curvature that may be used for sanding any appropriate surface including for example automobile parts such as trunk lids, doors, fenders, quarter panels; home products such as drywall, archways, ceiling coves, arch-back chairs; and boat products such as boat hulls. The sanding block 200 also includes a second sanding surface 230. The second sanding surface 230 is a flat surface with rounded edges that may be used for sanding any surface. The uses of the convex curvature 220 and the flat surface with rounded edges 230 are not limited to the applications disclosed herein.

The sanding block 200 also includes a third sanding surface 240 for sanding and/or rounding sharp edges of a surface to be sanded. The third sanding surface 240 is a concaved curvature that may be used to sand convex edges on curvatures on automobile ground effects, automobile spoilers; furniture such as dowels, spindles, rods, counter top edges, crown molding, or any other application. The use of the third sanding surface 240 is not limited to these particular applications.

The sanding block 200 further includes a fourth sanding surface 250 and a fifth sanding surface 260. The fourth sanding surface 250 is an anvil-shaped curvature, which may be used for sanding any appropriate surface including for example automobile parts such as bumper covers; and woodworking such as crown moldings, tow boards, and hard wood floors. The use of the anvil-shaped curvature 250 is not limited to these applications. The fifth sanding surface 260 is a claw-shaped curvature, which may be used for sanding any appropriate surface including for example automobile parts such as bumper covers, body side moldings, window trim; marine applications such as body side molding and window trim; and woodworking applications such as sand routed and detailed edges that need to remain sufficiently sharp. The use of the claw-shaped curvature 260 is not limited to these applications.

In an exemplary, non-limiting embodiment, the sanding block body 210 is made of a polyethylene foam with a density of approximately 1.8 pounds per cubic foot.

Figure 3:
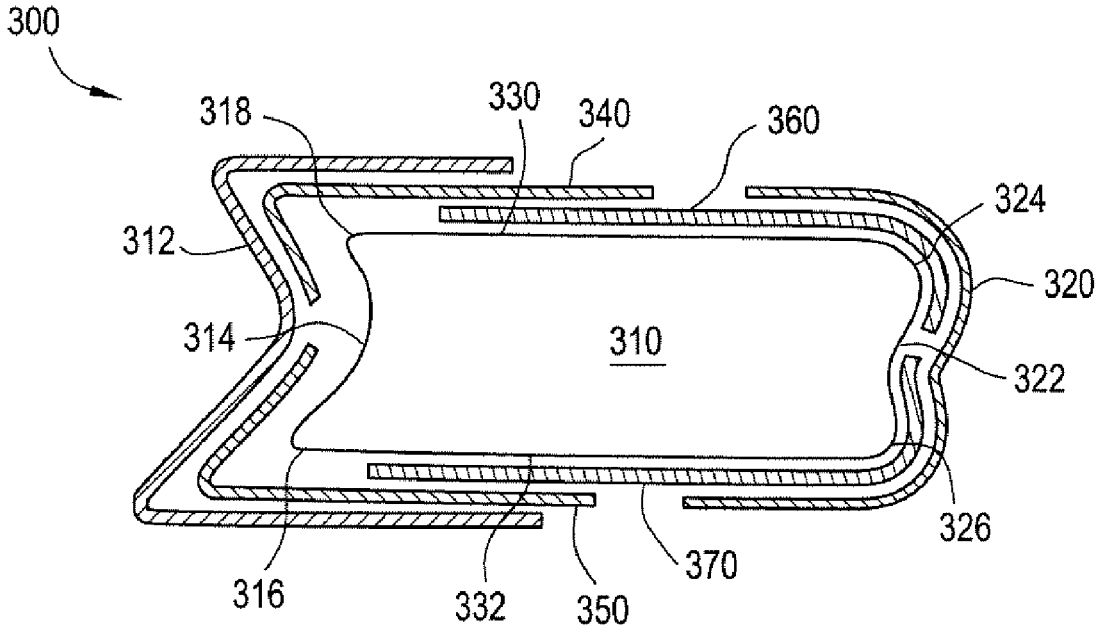
FIG. 3 is a cross-sectional view of another embodiment of a sanding block described herein.

FIG. 3 illustrates an exemplary embodiment of a sanding block 300 having a body 310 with offset flat sanding surfaces and curved sanding surfaces. The sanding block 300 includes offset shaped edges to allow the user's thumb and fingers to be positioned so as to not obstruct the view of the surface being sanded. The sanding block 300 includes a first sanding surface 312 comprising a first offset concaved curvature. The deepest portion 314 of the first offset concaved curvature 312 is not in the center of the curvature but is offset from the center. A first leg 316 of the first offset concaved curvature 312 may extend further than a second leg 318. The longer first leg 316 allows the user to rotate or pivot the sanding block 300 so that the sanding block 300 can reach deep around or behind pipes or spindles or any other surface to be sanded. The shorter second leg 318 allows the user to rotate or pivot the sanding block 300 so that other sides of the sanding block 300 can come in contact with a desired surface. For example, the shorter second leg 318 may be used so that the first offset concaved curvature 312 sands a quarter-round molding that has already been positioned on a wall.

The sanding block 300 includes a second sanding surface 320. The second sanding surface 320 is a second offset concaved curvature that may be shallower than the first offset concaved curvature 312. The deepest portion 322 of the offset concaved curvature 320 is not in the center of the curvature but is offset from the center. A rounded first leg 324 of the second offset concaved curvature 320 may extend further than a rounded second leg 326.

The first offset concaved curvature 312 and the second offset concaved curvature 320 may be used for sanding any appropriate surface including for example automobile parts such as convex edges, ground effects, spoilers, trunk parts, fenders, quarter panels, door jams, bumpers, and grills; home applications such as small bull-nose edges, quarter round moldings, doors, and window encasements; marine applications such as convex curvatures on slat edges on boat hulls; and woodworking applications such as furniture, dowels, spindles, rods, countertop edges, and crown moldings. The uses of the first and second offset concaved surfaces 312, 320 are not limited to these applications.

The sanding block 300 includes a first flat surface 330 and a second flat surface 332. The first flat surface 330 may be used in combination with the second leg 318 as a third sanding surface 340. The second leg 318 may be configured in an acute convex angle. The third sanding surface 340 may be used for sanding any appropriate surface including for example automobile parts such as indentations/grooves in bumper covers and body panels; home applications such as grooves and indentations around doors and windows; marine applications such as concaved curvatures on slat edges on boat hulls; and woodworking applications such as crown moldings, toe boards, routed detailed concaved curvatures for furniture and cabinetry. The use of the third sanding surface 340 is not limited to these applications.

The second flat surface 332 may be used in combination with first leg 316 to form a fourth sanding surface 350. The first leg 316 may be configured in an acute convex angle. The fourth sanding surface 350 may be used for sanding any appropriate surface including for example automobile parts such as indentations/grooves in bumper covers and body panels, and close to or underneath body side moldings and window trim; home applications such as corners and small coves and detailed work around windows; marine applications such as concaved curvatures on slat edges on boat hulls; and woodworking applications such as routed detailed edges in furniture and cabinetry. The use of the fourth sanding surface 350 is not limited to these applications.

The first flat surface 330 also may be combined with the rounded first leg 324 to create a fifth sanding surface 360, and the second flat surface 332 may be combined with the rounded second leg 326 to create a sixth sanding surface 370. The fifth and sixth sanding surfaces 360, 370 allow the flat surfaces 330, 332 to be more useable than a sanding block containing flat surfaces without rounded legs. For example, the user may hold the sanding block 300 at an angle about the rounded first leg 324 such that the user will be able to have greater access and range of motion. The rounded leg 324, 326 also may allow the sanding block 300 to more easily travel over different level surfaces. This will more readily prevent sandpaper gouging or other effects from the sandpaper binding upon the surface to be sanded.

The fifth and sixth sanding surfaces 360, 370 may be used for sanding any appropriate surface including for example automobile parts such as small indentations and grooves in bumper covers and body panels; home applications such as small coves and detailed work around windows and doors; marine applications such as concaved curvatures on slat edges on boat hulls; and woodworking applications such as crown moldings, toe boards, routed detailed concaved curvatures of furniture and cabinetry. The uses of the fifth and sixth sanding surfaces 360, 370 are not limited to these applications.

In an exemplary embodiment, the sanding block body 310 is made of a polyethylene foam with a density of approximately 1.8 pounds per cubic foot.

Figure 4:
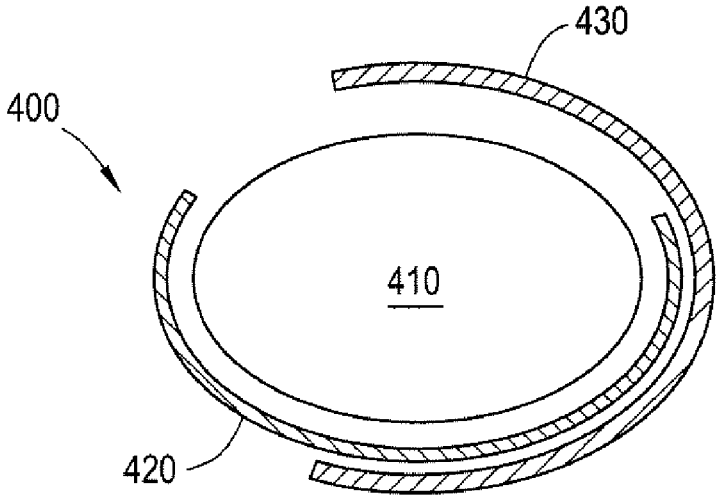
FIG. 4 is a cross-sectional view of still another embodiment of a sanding block described herein.

FIG. 4 illustrates an embodiment of the sanding block 400 having a body 410 with a substantially elliptical-shaped cross-section. The sanding block 400 includes a first sanding surface 420 and a second sanding surface 430. The first sanding surface 420 has a radius greater than the second sanding surface 430. The first sanding surface 420 and second sanding surface 430 have advantages over a round cylinder. The first sanding surface 420 may act as a French curve device when used in a sweeping motion. The first sanding surface 420 may be used for sanding any appropriate surface including for example automobile parts such as trunk lids, doors, fenders, hoods, quarter panels, and parts on motorcycles, snowmobiles, aircraft, or any other vehicle parts; home applications such as corner coves, ceiling coves, and crown moldings; marine applications such as boat hulls; and woodworking applications such as furniture arch-backed chairs, bed head boards, and trunks. The use of the first sanding surface 420 is not limited to these applications.

The second sanding surface 430 is shaped to resemble a lobe to allow the user access to tight areas where application calls for a rounded but deeper profile shape. The second sanding surface 430 acts similarly to a rounded cylinder that has been slightly pinched or compressed. The second sanding surface 430 may be used for sanding any appropriate surface including for example automobile parts such as concave irregular curvatures on ground effects, trunk lids, doors, fenders, quarter panels, and parts on motorcycles, snowmobiles, aircraft, or any other vehicle parts; home applications such as cove moldings, ceiling coves, and counter top back splashes; marine applications such as boat hulls; and woodworking applications such as cabinetry, furniture, and banisters. The use of the second sanding surface 430 is not limited to these applications.

In an exemplary embodiment, the sanding block body 410 is made of a polyethylene foam with a density of approximately 4.0 pounds per cubic foot.

Figure 5:
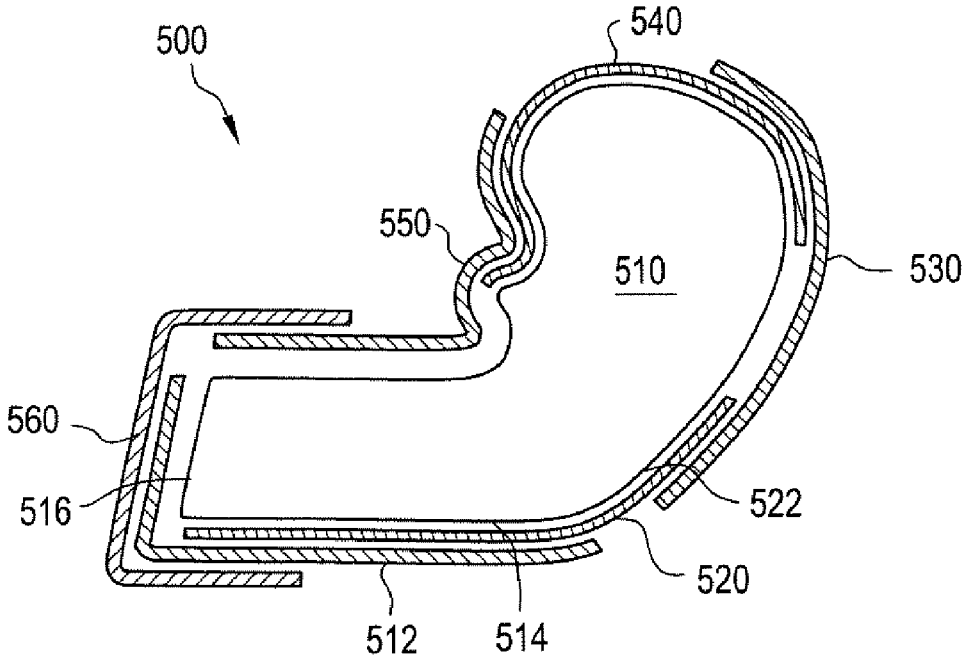
FIG. 5 is a cross-sectional view of yet another embodiment of a sanding block described herein.

FIG. 5 illustrates an exemplary embodiment of a sanding block 500 having a body 510 with a plurality of corners and coves. The sanding block body 510 is configured as a flat-bottomed sanding block with an acute angle on one side and an angular radius on another side accompanied by a full cove radius that has been designed to act as an offset handle which gives the user a clear view of the surface to be sanded, not obstructed by the user's hand. The sanding block body 510 includes a first sanding surface 512 that has a flat surface 514 with an adjoining angled edge 516. The angled edge 516 produces a slight wedge-shaped edge with the flat surface 514 that prevents the unintentional sanding of a less-than-prefect 90° wall or opposite surface. In an exemplary embodiment, the angled edge 516 is approximately three-quarters of an inch in height. The height of the angled edge 516 allows the user to aggressively sand, for example, dry wall compound without the unwanted gouging or scratching of the opposite wall. The angled edge is not limited to these dimensions, but may be any suitable height. The first sanding surface 512 allows the user to sand walls of a less-than-prefect 90° corner without the need to reposition the sanding block from wall to wall. The user needs only to pivot the sanding block to improve sanding without repositioning.

The sanding block 500 includes an overlap surface 520 which includes the flat surface 514 and an obtuse radius angle 522. The overlap surface 520 may be used as a sanding surface so that the obtuse radius angle 522 will allow the user to sand any irregular or difficult concaved curvatures.

The sanding block body 510 includes a second sanding surface 530 that includes a French curve-like shape. The second sanding surface 530 may be used in a sweeping motion to perform as a French curve. The French curve-like shape of the third sanding surface 530 provides more surface contact throughout the sweeping motion.

The sanding block 500 also includes a third sanding surface 540 that includes an elliptically shaped convex curvature with a wide radius. The third sanding surface 540 provides more contact area than a conventional round cylinder sander.

The sanding block 500 includes a fourth sanding surface 550 that has a concave curvature with a protrusion for sanding surfaces, such as ones in convex edges on ground effects and spoilers in automotive applications; convex curvatures on slats on boats; and dowels, spindles, rods, counter top edges, and crown molding in woodworking and furniture applications.

The sanding block 500 may include a fifth sanding surface 560 which includes a plurality of flat surfaces joined by the angled edge 516. The fifth sanding surface 560 may be used to sand any appropriate surface including for example automotive applications such as around and underneath body side moldings, window trim, indentations in bumper covers; marine applications such as around and underneath body side moldings and window trim; and woodworking applications such as furniture, cabinetry, and routed detailed edges that need to remain sharp. The fifth sanding surface 560 also is configured to operate as a handle (i.e., holding surface) while using the other sanding surfaces such as the second, third, and fourth sanding surfaces.

In an exemplary embodiment, the sanding block body 510 is made of a polyethylene foam with a density of approximately 4.0 pounds per cubic foot.

Figure 6:
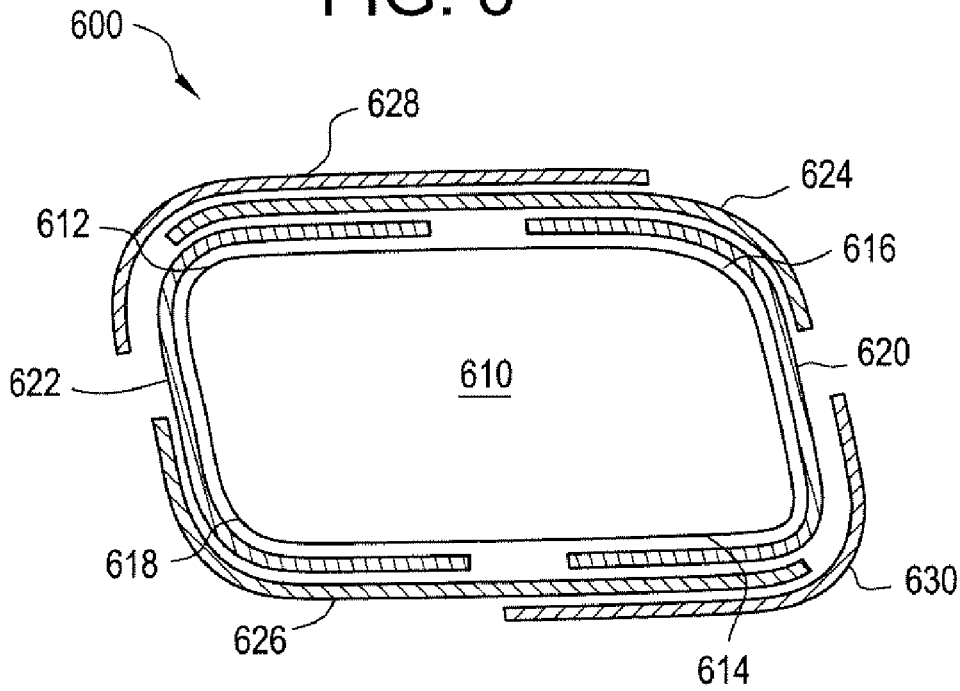
FIG. 6 is a cross-sectional view of another embodiment of a sanding block described herein.

FIG. 6 illustrates an embodiment of the sanding block 600 with a body 610 having a substantially parallelogram shape. Sanding block body 610 is a modified parallelogram designed with two acute but unequal angled edges 612 and 614 and two obtuse but unequal angled edges 616 and 618 creating four convex curvatures with different radii and four flat surfaces with varying lengths. Alternatively, the sanding block body could be a parallelogram that includes angled edges of the same radii. The sanding block has sanding surfaces 620, 622, 624, 626, 628, and 630. The sanding surfaces may be used for sanding on any appropriate surface including but not limited to automotive, marine, home, and woodworking applications.

In an exemplary embodiment, the sanding block body 610 is made of a polyethylene foam with a density of approximately 2.2 pounds per cubic foot.

Figure 7:
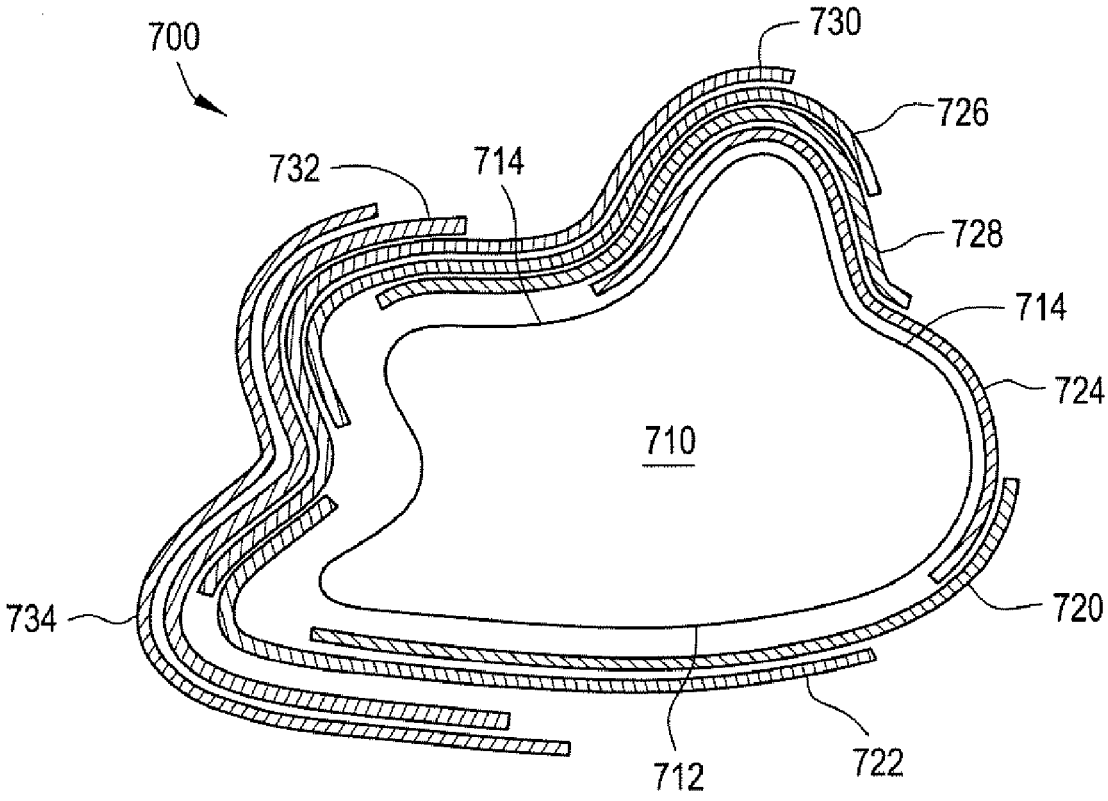
FIG. 7 is a cross-sectional view of a further embodiment of a sanding block described herein.

FIG. 7 illustrates an embodiment of the sanding block 700 with a body 710 having a plurality of convex and concave surfaces. The sanding block 700 includes a curved bottom 712 that resembles a segment of a traditional French curve accompanied by two different bull-nosed, concaved curvatures 714 and 716 that are designed for use when sanding less-than-perfect 90° corners. The sanding block 700 includes sanding surfaces 720, 722, 724, 728, and 732. The first sanding surface 720 is a French curve-like curvature. The second sanding surface 722 is a convex curvature with an acute convex edge. The third sanding surface 724 is a first concave curvature with convex edges. The fourth sanding surface 728 is a concave curvature with a protruding edge. The fifth sanding surface 732 is a concave curvature with two protruding edges. The concave channel of the fifth sanding surface 732 is operable for rounding and sanding edges. Overlap surfaces 726, 730, and 734, which include protrusions, may also be used as sanding surfaces. The protrusions of the sanding block 700 may have different respective lengths and widths for sanding crevices. The sanding block 700 may be pivoted with a rocking motion about curved bottom 712, which allows the user the option to apply pressure to ether side of the sanding block while sanding either of two opposing surfaces. The sanding surfaces may be used for sanding on any appropriate surface including but not limited to automotive, marine, home, and woodworking applications.

In an exemplary embodiment, the sanding block body 710 is made of a polyethylene foam with a density of approximately 4.0 pounds per cubic foot.

The sanding blocks described herein may be configured to hold a variety of sandpapers to sand essentially any surface. Examples of these surfaces include non-flat surfaces such as automotive parts, archways, ceiling coves, boat hulls, chairs, spindles, or any other non-flat or curved surface. The sanding blocks may be used in applications such as woodworking, marine vessel repair and production, auto body repair, building construction, and other industries.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in generic and descriptive sense only and not for purposes of limitation.

I claim:

1. A reusable sanding block for sanding a surface comprising:

an elongated body which has a first sanding surface, which comprises at least one curved surface; and a sandpaper removably affixed to the first sanding surface, wherein the body consists essentially of a closed-cell foam polymer and is elastically deformable such that the first sanding surface and the sandpaper can conform evenly against a curved surface to be sanded; and wherein the elongated body has a density between 1.8 pounds per cubic foot and 4 pounds per cubic foot.

2. The sanding block of claim 1, wherein the foam polymer is a polyethylene.

3. The sanding block of claim 1, wherein the sandpaper is adhered by a pressure-sensitive adhesive material.

4. The sanding block of claim 1, wherein the elongated body has a cross-sectional shape that is constant in the axial direction.

5. The sanding block of claim 1, wherein the curved sanding surface comprises a shape selected from the group consisting of concave curvatures, convex curvatures, anvil-shaped curvatures, claw-shaped curvatures, French-curve curvatures, and combinations thereof.

6. The sanding block of claim 1, wherein the elongated body further comprises a holding surface which allows the block to be securely held by a person's hand.

7. The sanding block of claim 1, wherein the first sanding surface comprises a convex curvature and the elongated body further comprises:

a second sanding surface which has a flat surface with rounded edges, a third sanding surface which has a concave curvature, a fourth sanding surface which has an anvil-shaped curvature, and a fifth sanding surface which has a claw-shaped curvature, wherein the foamed polymer comprises a polyethylene foam having a density of 1.8 pounds per cubic foot.

8. The sanding block of claim 1, wherein the first sanding surface comprises a first offset concaved curvature and the elongated body further comprises:

a second sanding surface which has second offset concaved curvature, a third sanding surface which has a first flat surface with an acute convex angle, a fourth sanding surface which has a second flat surface with an acute convex angle, a fifth sanding surface which has a first flat surface with a rounded edge, and a sixth sanding surface which has a second flat surface with a rounded edge, wherein the foamed polymer comprises a polyethylene foam having a density of 1.8 pounds per cubic foot.

9. The sanding block of claim 4, wherein the cross-sectional shape comprises an ellipse and the foamed polymer comprises a polyethylene foam having a density of about 4.0 pounds per cubic foot.

10. The sanding block of claim 1, wherein the first sanding surface comprises a flat surface with an acute angled edge and the elongated body further comprises:

a second sanding surface which has a French curve curvature, a third sanding surface which has an elliptical convex curvature, a fourth sanding surface which has a concave curvature with a protrusion, and a fifth sanding surface which has a flat rectangular surface, wherein the foamed polymer comprises a polyethylene foam having a density of 4.0 pounds per cubic foot.

11. The sanding block of claim 4, wherein the cross-sectional shape comprises a modified parallelogram having rounded corners and the foamed polymer comprises a polyethylene foam having a density of about 2.2 pounds per cubic foot.

12. The sanding block of claim 1, wherein the first sanding surface comprises a French curve curvature and the elongated body further comprises:

a second sanding surface which has a convex curvature with an acute convex angle, a third sanding surface which has a first concave curvature with convex edges, a fourth sanding surface which has a concave curvature with a protruding edge, and a fifth sanding surface which has a concave curvature with two protruding edges, wherein the foamed polymer comprises a polyethylene foam having a density of 4.0 pounds per cubic foot.

13. A kit of parts for sanding surfaces, the kit comprising:

two or more reusable sanding blocks, each sanding block including an elongated body having a first sanding surface, which comprises at least one curved surface to which sandpaper may be removably affixed, wherein the body comprises a closed-cell foam polyethylene and is elastically deformable such that the first sanding surface can conform against a curved surface to be sanded, wherein the shapes of the first sanding surfaces of the two or more sanding blocks, and the densities of the foamed polymers of the two or more sanding blocks, differ from one another; and wherein the elongated body has a density between 1.8 pounds per cubic foot and 4 pounds per cubic foot.

14. The kit of claim 13, further comprising an adhesive-backed sandpaper which is adapted to be removably affixed to each of the first sanding surfaces.

15. The sanding block of claim 1, which is made by an extrusion process.

* * * * *